US005371447A

United States Patent [19]

Boss

[11] Patent Number: 5,371,447

[45] Date of Patent: Dec. 6, 1994

[54] REPOSITIONING SYSTEM

[76] Inventor: Daniel V. Boss, 611 Highland Ave., Half Moon Bay, Calif. 94019

[21] Appl. No.: 32,964

[22] Filed: Mar. 18, 1993

[51] Int. Cl.[5] ..... E05F 15/20; H01H 43/00

[52] U.S. Cl. ..... 318/265; 160/1; 160/331; 388/907.5; 49/29; 318/468; 318/470; 318/484

[58] Field of Search ..... 318/264, 265, 266, 267, 318/286, 466, 467, 468, 470, 484, 490; 160/1, 330, 331; 388/907.5, 909; 49/29, 30

[56] References Cited

U.S. PATENT DOCUMENTS 3,802,479 4/1974 Newell, III et al. .
4,131,831 12/1978 Bochenek et al. ..... 318/282
4,610,294 9/1986 Anesi et al. ..... 160/331
4,775,039 10/1988 Sunakawa ..... 192/0.02
4,819,708 4/1989 Onosato et al. .
4,856,574 8/1989 Minami et al. .
4,864,201 9/1989 Bernot ..... 318/480
4,926,922 5/1990 Shimazaki ..... 160/331
4,958,112 9/1990 Zerillo ..... 318/280
4,995,442 2/1991 Marzec ..... 160/331
5,270,629 12/1993 Hsieh ..... 318/600

*Primary Examiner*—Bentsu Ro
*Attorney, Agent, or Firm*—Donald C. Feix

[57] ABSTRACT

Apparatus and methods for positioning a drape covering for a window comprise an electric stepper motor and an automated control for actuating the electric stepper motor to move the drape to any selected position at any selected time and in any selected sequence of drape movements.

13 Claims, 5 Drawing Sheets 25
52
DC
POWER SUPPLY
AC1
AC INPUT 16.5VAC
AC2
57
55
41
53
44
43
EPROM
80C31 MICROPROCESSOR
61
29
MOTOR DRIVER
27
49
33
1
2
3
4
47
45
DISPLAY DRIVER
35

REPOSITIONING SYSTEM

BACKGROUND OF THE INVENTION

This invention relates to apparatus and methods for positioning a drape or other movable, pull cord actuated covering for a window.

SUMMARY OF THE INVENTION

The present invention provides automated control apparatus and methods for actuating an electric geared stepper motor to move a drape to any selected position at any selected time and in any selected sequence of drape movements.

The automated control includes a programmable computer, a clock input to the computer, a manually actuated control buttons signal input device. The control buttons signal input device transmits position and time signals to the computer for selecting a plurality of events with each event defining a particular position to which the drape is moved and the particular time the drape is to be moved to that particular position.

A numeric LED display displays time information, event information, and prompt information for inputting positions and times.

The computer includes memory for receiving and storing the position and time signals which are input by the manually actuated control buttons signal input device. The stored signals are effective in combination with the clock to cause the automated control to actuate the electric stepper motor to move the drape to each selected position at each selected time.

In one specific embodiment of the present invention, the automated control permits six separate programmed events to be programmed into the computer to produce up to six positions and times for moving the drapes in six separate positions between full opened and full closed positions.

The memory includes non-volatile memory for retaining drape position and time information during and after a power failure and without the need for battery backup.

The automated control permits a review of all of the drape position and time information after all the event programming has been completed.

The automated control includes a manual override for actuating the electric stepper motor to drive the drape to any desired position at any time, even if the event programming calls for a different position at that particular time, without changing the programmed event. The manual override can also disable the auto mode.

The manually actuated signal input can be actuated to change the speed and torque of the electric stepper motor.

The speed of the electric stepper motor can be set slow enough so that movement of the drape does not set off a motion detector in the room in which the drape is located.

The electric stepper motor is effective to produce accurate and repeatable position control without feedback control or position switches.

The electric stepper motor is connected to the drape pull mechanism by a chain and a ball chain pulley formed with dimples to provide positive traction between the stepper motor and the drape pull cord mechanism.

Automated control apparatus and methods which are constructed as described above and which are effective to function as described above constitute specific objects of this invention.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWING VIEWS

FIG. 1 is a front elevation view of a window having a drape which is positionable at a plurality of preprogrammed, selected positions at predetermined, selectable times by an automated control apparatus and method constructed and operating in accordance with one embodiment of the present invention.

FIG. 2 is a schematic view showing components of the programmable computer used in the drape automated control apparatus and method of the present invention. FIG. 2 includes, in the lower right hand corner of FIG. 2, a schematic view of the motor driver and stepper motor 27 controlled by the programmable computer. The stepper motor 27 is used to move the drape to the various positions illustrated in FIG. 1.

FIGS. 3A, 3B and 3C are a flow diagram of the source code of the programmable computer shown in FIG. 2.

DESCRIPTION OF THE PREFERRED EMBODIMENTS

Figure 1:
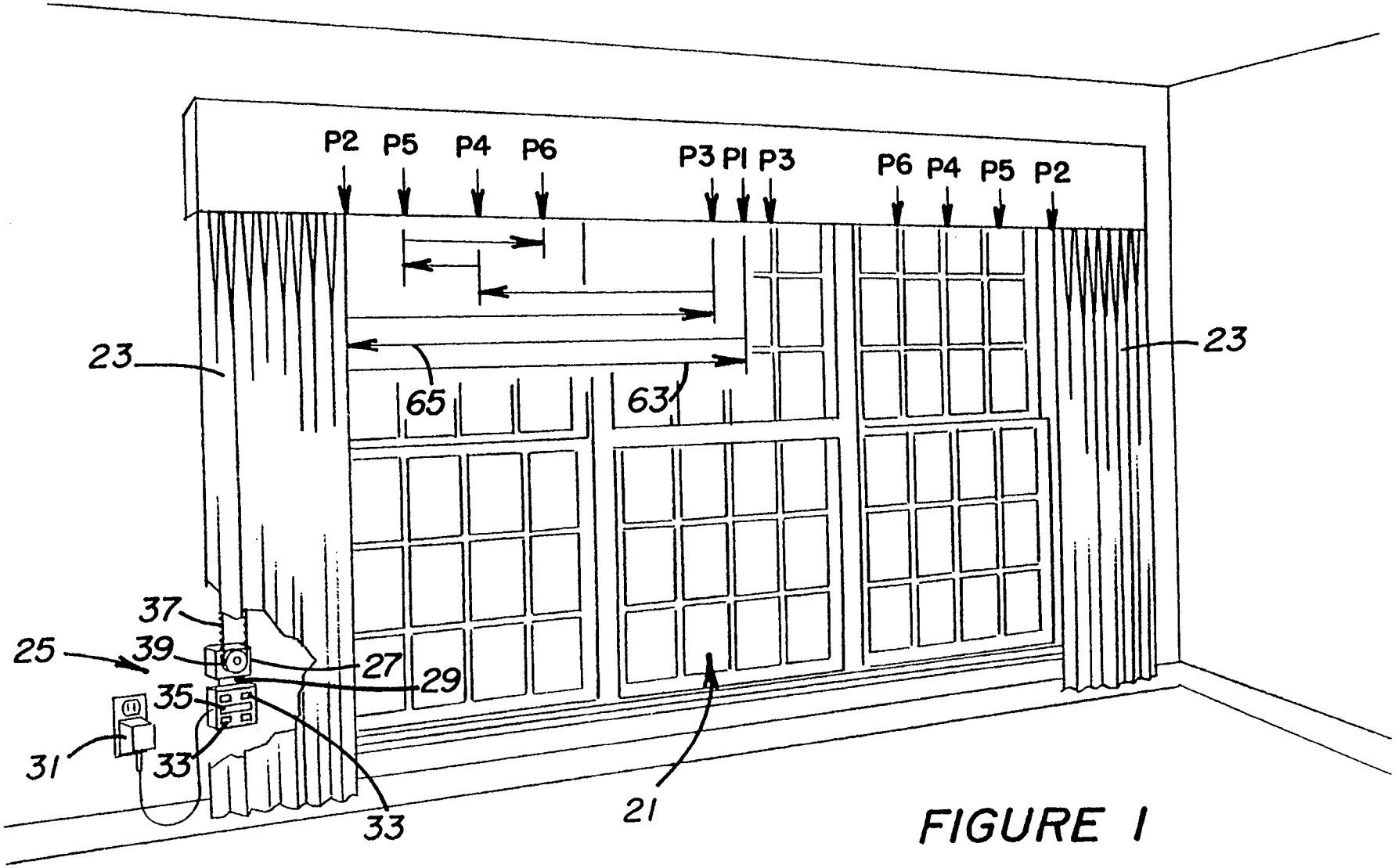

FIG. 1 is a front elevation view of a window 21 having a drape 23 which is positionable by an automated control apparatus 25 and method constructed and operating in accordance with one embodiment of the present invention.

As will be described in more detail in the description to follow, the automated control 25 enables the draperies 23 to be positioned at a plurality of pre-programmed selected positions (as indicated by the positions P1, P2, P3, P4, P5, and P6 at the top of FIG. 1) at predetermined, selectable times.

In accordance with the present invention, the automated control 25 actuates an electric stepper motor 27 to move the drapes 23 to any selected position at any selected time and in any selected sequence of drape movements.

The automated control 25 (which includes software in an EPROM 43), as will be described in more detail below, includes a programmable computer 41 (see FIG. 2) supplied with power from a transformer 31, a real time signal input 53 to the computer, a manually actuated signal input 33 for inputting position and time signals into the computer for selecting an event defining each position to which the drape is moved and the time the drape is to be at each such position, a display 35 for displaying clock time information, event information, and prompt information for inputting positions and times, and memory in the microprocessor 41 for receiving and storing the position and time signals which are input by the manually actuated signal input 33 and which are effective (in combination with timing in the software process that monitors line voltage) to cause the control to actuate the electric stepper motor 27 to drive the drape to each selected position at each selected time.

As illustrated in FIG. 1, the automated control 25 permits six separate programmed events to be programmed into the computer to produce up to six separate positions and times for moving the drape to six separate positions between full opened and full closed.

The memory that stores the events is in the microprocessor 41. The memory that stores the code (the software program) is in the EPROM 43 and includes non volatile memory for retaining drape position and time information during and after a power failure and without the need for battery backup.

The control 25 includes time setting means 33 for setting the correct real time in the clock 51 after all of the event programming has been completed.

The automated control includes review means 35, 33 for reviewing all of the drape position and time information after all of the event programming has been completed.

The automated control 25 includes a manual override 33 for actuating the electric motor 27 to drive the drape to any desired position at any time, even if the event programming calls for a different position at that particular time, without changing programmed events.

Figure 2:
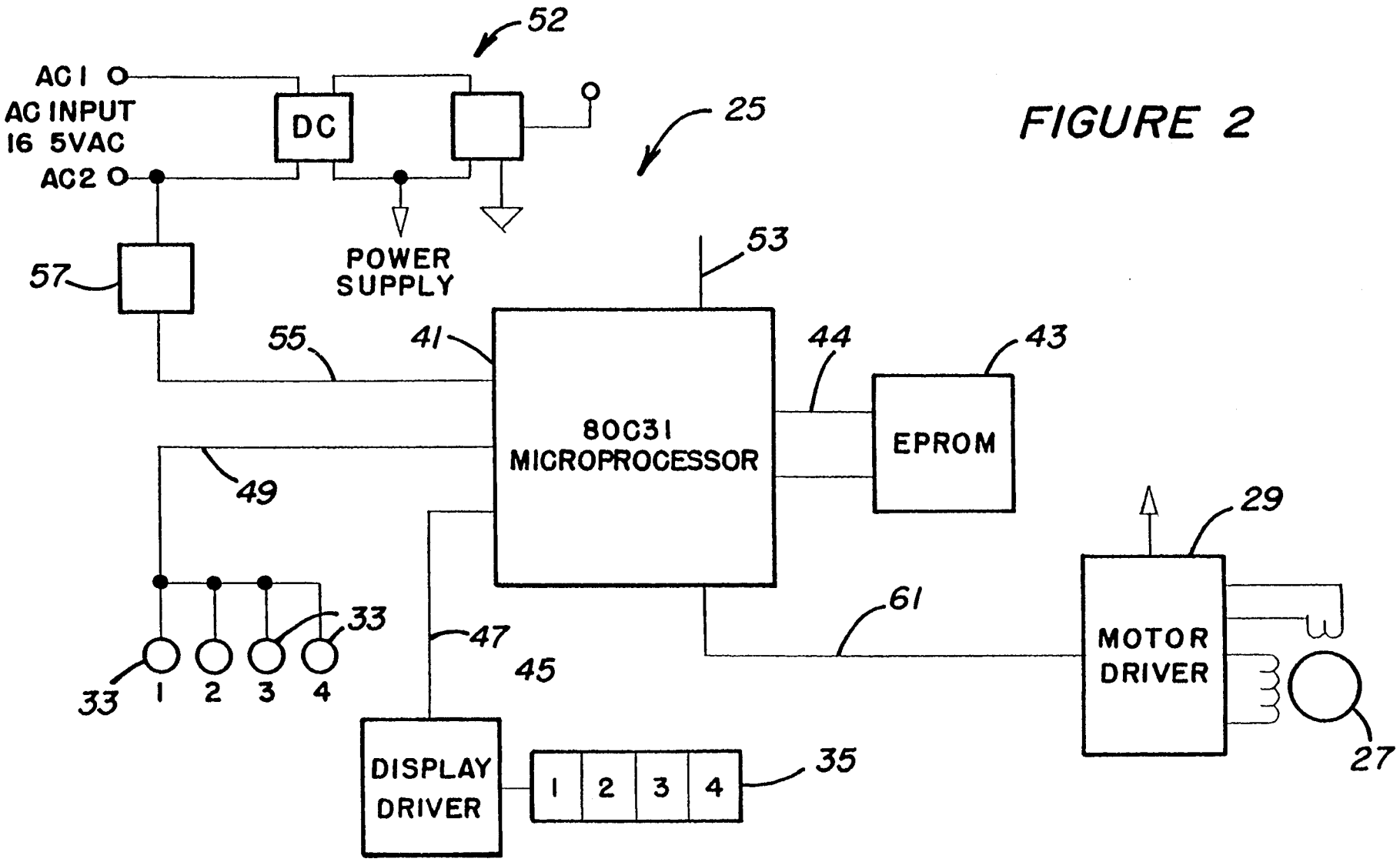

In a specific embodiment of the invention, the manually actuated signal input 33 includes a keyboard having four numbered, depressible keys 33 (numbered 1, 2, 3 and 4 in FIG. 2).

The manually actuated signal input 33 can be actuated to change the speed and the torque of the electric stepper motor 27. The speed of the electric motor 27 can be set slow enough so that the movement of the drape 23 does not set off a motion detector in the room in which the drape is located.

The electric motor 27 is a stepper motor 27 effective to produce accurate and repeatable position control without feedback control or position switches.

The stepper motor 27 is connected to the drape pull cord apparatus by a ball chain 37 and a ball chain pulley 39 formed with dimples to provide positive traction between the stepper motor 27 and the pull cord mechanism.

The ball chain 37 is connected directly to the existing pull cords of the drape 23.

As shown in FIG. 2, the programmable control 25 includes a programmable microprocessor 41, an electrically programmable read only memory 43 connected to the microprocessor by a bus 44, a display driver 45 connected to the microprocessor 41 by a bus 47, and a bus 49 connecting the four input control buttons 33 to the microprocessor 41.

A power supply 52 is connected to the microprocessor 41 by a bus 55, and an alternating current loss detector 57 is connected between the power supply 52 and the microprocessor 41.

As shown in FIG. 4, the stepper motor 27 is driven by a motor driver 29, and the motor driver 29 is connected by a bus 61 to the microprocessor 41.

Figure 3A:
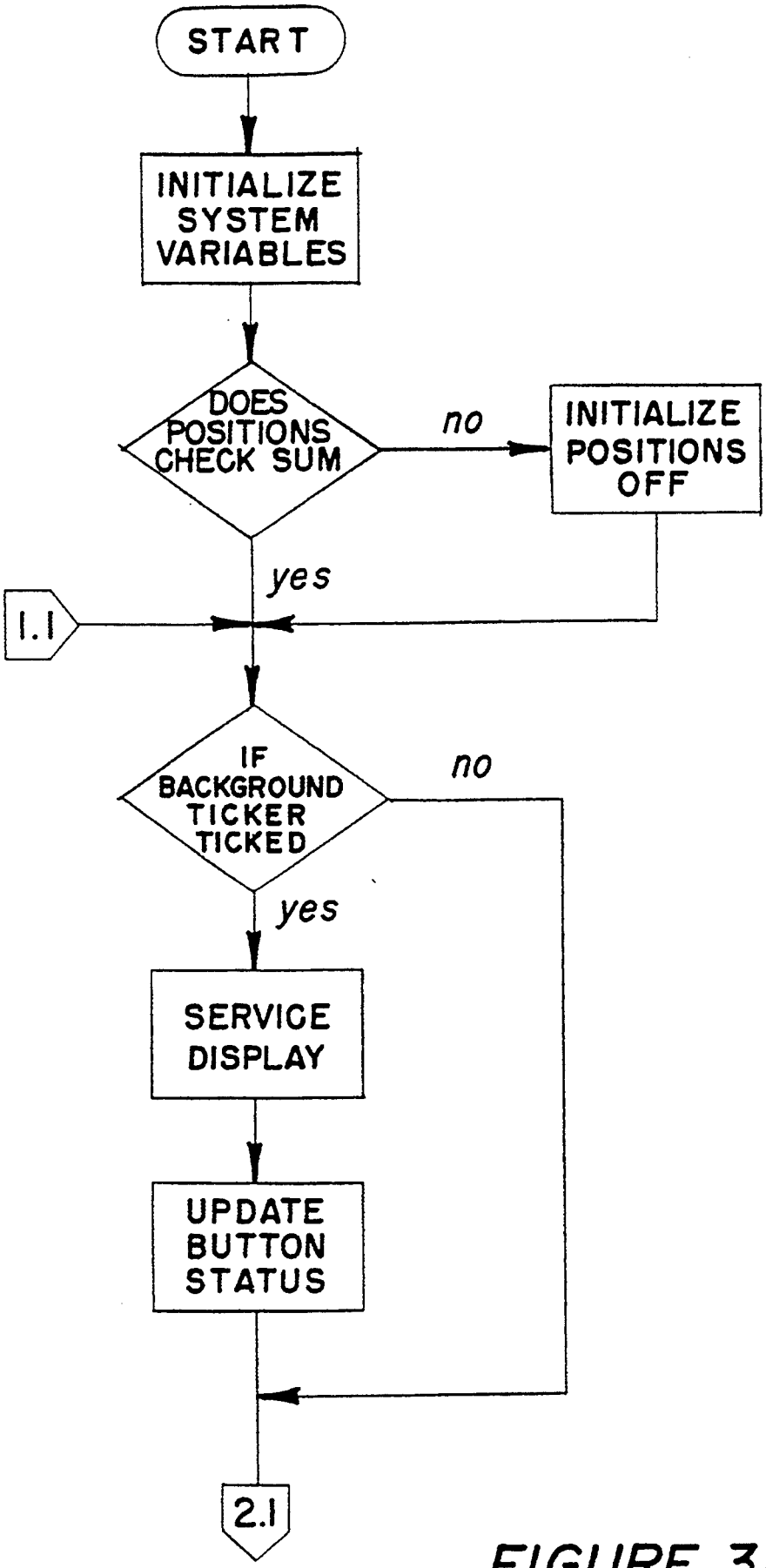
Figure 3B:
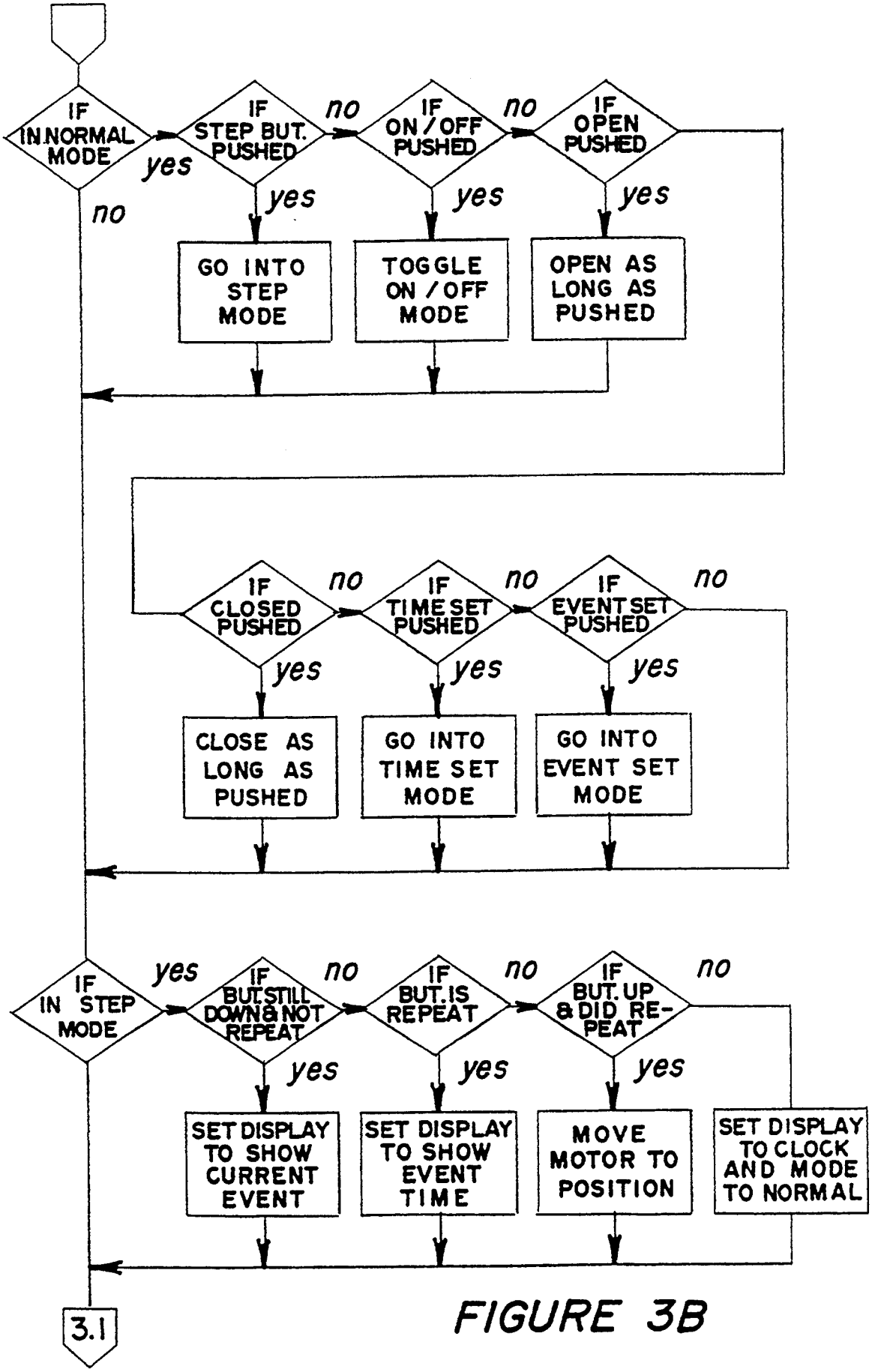
Figure 3C:
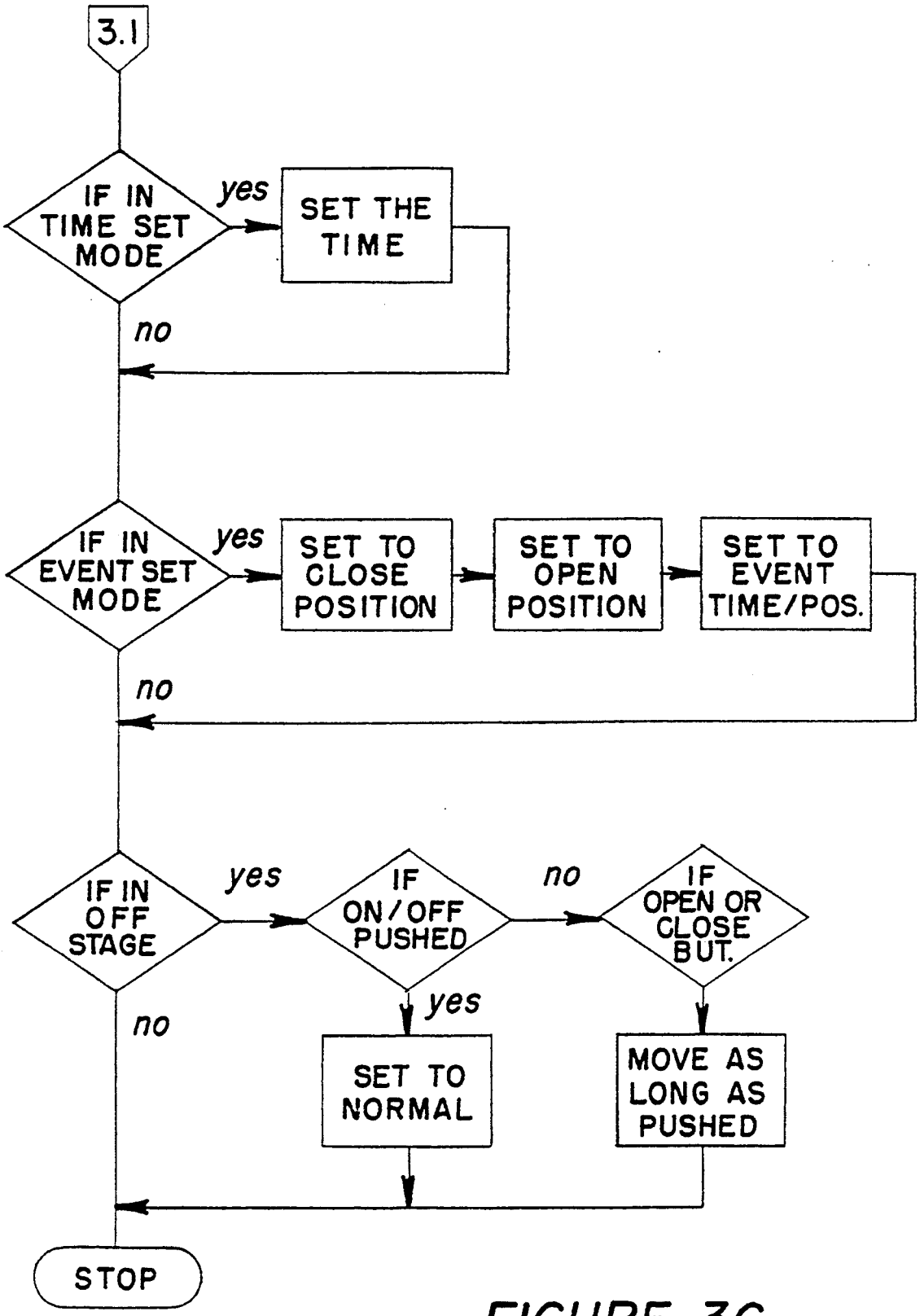

FIGS. 3A, 3B and 3C are sequential views of a flow diagram of the source code of the programmable computer used in the automated control 25.

In the operation of the automated control 25 in accordance with the present invention, the first thing to do is the initial set up.

In the initial set up, buttons 1 and 2 of the signal input 33 (see FIG. 2) are depressed simultaneously. This prompts the user to close the drapes, in order that he may establish that limit. At this time CLSE is displayed on the display 35.

This is a prompt to move the drape physically to the closed position (position P1 shown in FIG. 1). The drapes are moved to this fully closed position (in the direction indicated by the directional arrow 3) by pushing button number 4 of the signal input 33 to take the drape to the fully closed position.

When the drape is fully closed, button number 2 is pushed.

At this point the automated control is ready for set up of the open position.

The display 35 tells the operator to do the same thing for OPEN as had been done for CLSE.

The operator then pushes button number 3 to move the drapes to the fully opened position P2 (see FIG. 1) in the direction indicated by the directional arrow 65.

This sets the open limit.

The operator keeps his finger on button number 3 until the drapes arrive at the full open position.

The operator then presses button number 2 again to get to the next phase of initialization, which takes the control 25 into the event definition.

At this point the operator defines the events, the positions wanted for the drape, and then the time that the operator wants the drape to move to each such position.

These events can be done for six different positions at six different times in one specific embodiment of the control of the present invention.

The display 35 starts off with number 1 to show that there is nothing in the computer at this stage in the event programming following the set-up phase of the initialization.

For simplicity of description of the operation, the event number 1 position will be illustrated as the fully closed position P1, although the drape could be set at any other position from full opened to full closed, if so desired for event number 1.

Therefore, button number 4 is pressed to move the drape to position P1 for event 1.

The operator then presses buttons 1 and 3 to get a prompt to enter the time.

The display 35 then shows the current time and the operator presses button 3 to change the hour and button 4 to change the minute to the desired time.

The operator then pushes button number 2 to program event number 2.

The operator, for all event programming, presses button number 4 to move toward the closed position and presses button number 3 to move toward the open position.

In the event setting illustrated in FIG. 1, event 2 is set for the full open position P2.

After the desired second position has been reached, the operator presses buttons 1 and 3 to get a prompt to enter the time and then presses buttons 3 and 4 to set the desired event time.

The other event positions (P3, P4, P5 and P6) and event times are set in the same way as events 1 and 2 (P1 and P2 as illustrated in the drawings).

After the event positions and times have been set, the operator sets the actual time, and the automated control 25 will automatically operate the drapes to position the drapes at each of the programmed positions at each of the programmed times, until such time as the automated control is reprogrammed to change the position and time information for any particular event or events.

The automated control also enables the speed of the motor to be changed by pushing the selected buttons on the signal input 33.

To change the speed and/or the direction of the stepper motor 27, buttons 1 and 3 are simultaneously depressed, and then buttons 1 and 2 are simultaneously depressed. Button 1 is then pressed to change the speed of the stepper motor in auto mode and button 2 is pressed to change speed of the stepper motor in manual mode.

The speed of the stepper motor can be set so that the stepper motor can provide greater torque at slower speed or can supply greater speed at lower torque.

The speed of the stepper motor can also be set slow enough so that the movement of the drapes will be slow enough to avoid setting off any motion detector.

The direction of the motor 27 can be changed in the configure mode (after buttons 1 and 3 and then buttons 1 and 2 have been simultaneously depressed), by depressing button 4. In this configure mode, button 4 acts as a toggle to switch the direction.

If there is a power failure, the AC loss detector 57 sends a signal to the microprocessor 41. This signal causes the automated control to power down and to retain (in the nonvolatile memory 43) program information so that the control does not forget program information previously programmed into the computer during the initialization and programming operations.

Any manual electrical control of drape position (through the control buttons 33) also does not lose the position and time information which was programmed into the automated control 25 during the initialization and event programming.

While I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

I claim:

1. Apparatus for positioning a drape or other movable, pull cord actuated covering for a window, said apparatus comprising, electric motor means connectable to the pull cord and effective to drive the drape to selected full opened and full closed positions and also to selected positions between said full closed and full opened positions, control means for actuating the electric motor means to move the drape to any selected position at any selected time and in any selected sequence of drape movements, said control means including, a programmable computer, a clock input to the computer, manually actuated signal means for imputing position and time signals into the computer for selecting an event defining each position to which the drape is to be moved and the time the drape is to be at each such position, display means for displaying clock time information, event information, and prompt information for inputting positions and times, and memory means in the computer for receiving and storing the position and time signals input by the manually actuated signal means and effective in combination with the clock to cause the control means to actuate the electric motor means to move the drape to each selected position at each selected time.

2. The invention defined in claim 1 wherein the full opened and full closed positions are input as limits in the control means by manually controlling the control means to drive the electric motor means to the respective full opened and full closed positions.

3. The invention defined in claim 1 wherein the control means permits six separate programmed events to be programmed into the computer to produce up to six separate positions and times for moving the drape to six separate positions between said full opened and full closed positions.

4. The invention defined in claim 1 wherein the memory means includes non-volatile memory for retaining drape position information during and after a power failure and without the need for battery back up.

5. The invention defined in claim 1 wherein the control means includes time set means for setting the correct real time in the clock after all of the event programming has been completed.

6. The invention defined in claim 1 wherein the control means includes review means for reviewing all of the drape positions and time information after all of the event programming has been completed.

7. The invention defined in claim 1 wherein the control means includes manual override means for actuating the electric motor means to drive the drape to any desired position at any time, even if the event programming calls for a different position at that particular time, without changing the programmed events.

8. The invention defined in claim 1 wherein the manually actuated signal means includes a keyboard having four numbered, depressible keys.

9. The invention defined in claim 1 wherein the manually actuated signal means can be actuated to change the speed and torque of the electric motor means.

10. The invention defined in claim 1 wherein the manually actuated signal means can be actuated to reverse the motor direction.

11. The invention defined in claim 9 wherein the speed of the electric motor means can be set slow enough so that movement of the drape does not set off a motion detector in the room in which the drape is located.

12. The invention defined in claim 1 wherein the electric motor means is a stepper motor effective to produce accurate and repeatable position control without feedback control or position switches.

13. The invention defined in claim 12 wherein the stepper motor is connected to the drape pull cord mechanism by a ball chain and a ball chain pulley formed with dimples to provide positive traction between the stepper motor and the drape pull cord mechanism.

* * * * *